US007503313B2

(12) United States Patent
Achleitner et al.

(10) Patent No.: US 7,503,313 B2
(45) Date of Patent: Mar. 17, 2009

(54) METHOD AND DEVICE FOR CONTROLLING AN INTERNAL COMBUSTION ENGINE

(75) Inventors: Erwin Achleitner, Obertraubling (DE); Martin Cwielong, Regensburg (DE); Gerhard Eser, Hemau (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/662,929

(22) PCT Filed: Aug. 8, 2005

(86) PCT No.: PCT/EP2005/053901

§ 371 (c)(1),
(2), (4) Date: Mar. 16, 2007

(87) PCT Pub. No.: WO2006/032577

PCT Pub. Date: Mar. 30, 2006

(65) Prior Publication Data

US 2007/0295310 A1 Dec. 27, 2007

(30) Foreign Application Priority Data

Sep. 21, 2004 (DE) ..... 10 2004 045 738

(51) Int. Cl.
*F02M 37/04* (2006.01)
*F02M 41/00* (2006.01)

(52) U.S. Cl. ..... 123/446; 123/447; 123/497

(58) Field of Classification Search ..... 123/446–447, 123/457–458, 497

See application file for complete search history.

(56) References Cited

U.S. PATENT DOCUMENTS

| | | | | | |
|---|---|---|---|---|---|
| 5,505,180 | A * | 4/1996 | Otterman et al. | ..... | 123/497 |
| 5,819,196 | A * | 10/1998 | Holmes et al. | ..... | 701/103 |
| 5,819,709 | A * | 10/1998 | Holmes et al. | ..... | 123/497 |
| 5,971,718 | A * | 10/1999 | Krueger et al. | ..... | 417/286 |
| 6,142,120 | A * | 11/2000 | Biester et al. | ..... | 123/456 |
| 6,234,148 | B1 * | 5/2001 | Hartke et al. | ..... | 123/447 |
| 6,253,734 | B1 * | 7/2001 | Rembold et al. | ..... | 123/446 |
| 6,293,253 | B1 * | 9/2001 | Arnold et al. | ..... | 123/458 |
| 6,345,608 | B1 * | 2/2002 | Rembold et al. | ..... | 123/506 |
| 6,609,500 | B2 * | 8/2003 | Ricco et al. | ..... | 123/446 |
| 6,718,948 | B2 * | 4/2004 | Vahle et al. | ..... | 123/458 |
| 6,748,924 | B2 * | 6/2004 | Yu | ..... | 123/458 |
| 6,840,220 | B2 * | 1/2005 | Yomogida et al. | ..... | 123/456 |
| 6,976,473 | B2 * | 12/2005 | Boos et al. | ..... | 123/446 |
| 7,077,107 | B2 * | 7/2006 | Boos et al. | ..... | 123/446 |
| 7,121,263 | B2 * | 10/2006 | Eser | ..... | 123/446 |
| 7,128,054 | B2 * | 10/2006 | Koehler et al. | ..... | 123/446 |
| 7,207,319 | B2 * | 4/2007 | Utsumi | ..... | 123/446 |

(Continued)

FOREIGN PATENT DOCUMENTS

DE 197 39 653 A1 3/1999

(Continued)

*Primary Examiner*—Thomas N Moulis

(57) ABSTRACT

The invention relates to an internal combustion engine comprising a fuel supplying device. Said fuel supplying device comprises a low-pressure circuit provided with a low-pressure pump and a high-pressure pump that is coupled to the low-pressure circuit on the input side and transports fuel into a fuel accumulator. A fuel transporting flow of the low-pressure pump is corrected according to an actual and a previously pre-determined nominal value of the fuel pressure in the fuel accumulator.

14 Claims, 5 Drawing Sheets

U.S. PATENT DOCUMENTS

| | | | | |
|---|---|---|---|---|
| 7,240,667 | B2 * | 7/2007 | Dolker | 123/456 |
| 7,302,935 | B2 * | 12/2007 | Achleitner et al. | 123/446 |
| 7,343,901 | B2 * | 3/2008 | Mori et al. | 123/446 |

FOREIGN PATENT DOCUMENTS

| | | | |
|---|---|---|---|
| DE | 198 53 823 | A1 | 5/2000 |
| DE | 199 51 410 | A1 | 5/2001 |
| DE | 101 62 989 | C1 | 10/2003 |
| DE | 103 00 929 | A1 | 8/2004 |
| EP | 1 281 860 | A2 | 2/2003 |
| WO | WO 01/53686 | A2 | 7/2001 |

* cited by examiner

METHOD AND DEVICE FOR CONTROLLING AN INTERNAL COMBUSTION ENGINE

CROSS REFERENCE TO RELATED APPLICATIONS

This application is the U.S. National Stage of International Application No. PCT/EP2005/053901, filed Aug. 8, 2005 and claims the benefit thereof. The International application claims the benefits of German application No. 10 2004 045 738.7 filed Sep. 21, 2004, both of the applications are incorporated by reference herein in their entirety.

FIELD OF INVENTION

The invention relates to a method and an associated device for controlling an internal combustion engine with the aid of a fuel delivery device. Said fuel delivery device comprises a low-pressure circuit provided with a low-pressure pump and a high-pressure pump that is coupled to the low-pressure circuit on the input side and conveys fuel into a fuel accumulator.

BACKGROUND OF THE INVENTION

A fuel delivery device of the said kind is known from DE 101 62 989 C1. Further disclosed is a circuit arrangement for regulating an adjustable fuel pump for an injection system of an internal combustion engine, said arrangement being provided with a controller which compares a desired value of a fuel pressure with an actual value of the fuel pressure and determines an adjustment value for the delivery rate of the fuel pump as a function of the difference between the values. Furthermore a pilot control unit and an adder unit are provided. The adder unit determines a control signal from the adjustment value and a pilot control value for regulating the delivery rate of the fuel pump. The pilot control unit determines the pilot control value as a function of a desired delivery volume.

SUMMARY OF INVENTION

The object of the invention is to create a method and an associated device that can provide reliable control of an internal combustion engine in a simple manner.

This object is achieved by means of the features which will emerge from the independent claims. Further advantageous embodiments of the invention are characterized in the dependent claims.

The invention is characterized by a method and an associated device for controlling an internal combustion engine with the aid of a fuel delivery device. Said fuel delivery device comprises a low-pressure circuit provided with a low-pressure pump and a high-pressure pump that is coupled to the low-pressure circuit on the input side and delivers fuel into a fuel accumulator. A fuel delivery flow of the low-pressure pump is corrected as a function of a current and a preceding predetermined setpoint value of the fuel pressure in the fuel accumulator.

This has the advantage that the fuel delivery flow of the low-pressure pump can be controlled so as to take into account an additional quantity of fuel that is conveyed by the high-pressure pump from the low-pressure circuit into the fuel accumulator due to an increase in the predetermined setpoint value of the fuel pressure or a smaller quantity of fuel conveyed by the high-pressure pump from the low-pressure circuit into the fuel accumulator or drained off from the fuel accumulator into the low-pressure circuit due to a reduction in the predetermined setpoint value of the fuel pressure. An unwanted increase or reduction in the fuel pressure within the low-pressure circuit can be avoided in this way.

By taking into account the current and preceding predetermined setpoint values of the fuel pressure, the fuel delivery flow of the low-pressure pump can be corrected virtually without delay. In this way the components in the low-pressure circuit, such as the low-pressure pump or a pressure relief valve, can be very easily kept free of overload and thus protected from damage. This enables the fuel delivery device to be particularly reliable.

The current and the preceding predetermined setpoint values of the fuel pressure in the fuel accumulator are preferably determined as a function of operating variables or the operating mode of the internal combustion engine, for example as a function of an engine speed or a fuel mass that needs to be injected, or as a function of a homogeneous or layered operation.

The preceding predetermined setpoint value of the fuel pressure is a predetermined setpoint value of the fuel pressure that was determined at some time prior to the current predetermined setpoint value of the fuel pressure, and was determined for example in the last preceding stationary phase of the setpoint value of the fuel pressure.

The fuel pressure in the fuel accumulator is preferably adjusted by a control device as a function of the current predetermined setpoint value of the fuel pressure.

In an advantageous embodiment of the invention, correction of the fuel delivery flow of the low-pressure pump is activated as a function of the current and the preceding predetermined setpoint values of the fuel pressure in the fuel accumulator. This has the advantage that the fuel delivery flow of the low-pressure pump is corrected only when necessary. Preferably correction of the fuel delivery flow of the low-pressure pump is started if the predetermined setpoint value of the fuel pressure is changed by a large amount, that is to say, when for example the amount of the difference between the current and the preceding predetermined setpoint values of the fuel pressure is about 100 bar or the ratio between the current and the preceding predetermined setpoint value of the fuel pressure amounts to about 50 percent.

In a further advantageous embodiment of the invention, a first correction value is determined when correction of the fuel delivery flow of the low-pressure pump is activated. The first correction value is determined as a function of a current and a preceding quantity, said quantity being representative of a fuel delivery flow of the high-pressure pump, which fuel delivery flow is set in each case as a function of the current predetermined setpoint value of the fuel pressure in the fuel accumulator. The fuel delivery flow of the low-pressure pump is corrected as a function of the first correction value.

The invention utilizes the finding that the fuel delivery flow of the high-pressure pump is controlled or adjusted in each case as a function of the current predetermined setpoint value of the fuel pressure in the fuel accumulator, and that the current and preceding quantities then contain information about how the fuel delivery flow of the high-pressure pump changes following a change in the predetermined setpoint value of the fuel pressure. This information can be very easily put to use for the purpose of making an appropriate adjustment to the fuel delivery flow of the low-pressure pump. The quantity that is representative of a fuel delivery flow of the high-pressure pump may be a corrective signal for setting the fuel delivery flow of the high-pressure pump, or may equally be a measured value of a measurement variable captured by a sensor, or an estimated quantity.

In this connection it is advantageous if the first correction value is assigned a neutral value after a predetermined interval immediately following the last activation of correction to the fuel delivery flow of the low-pressure pump. This has the advantage that the correction to the fuel delivery flow of the low-pressure pump is limited in time and that otherwise there is no intervention in any control or adjustment that may be provided as necessary for the fuel pressure in the low-pressure circuit.

In this connection it is a further advantage to determine a current second correction value, equal to the first correction value, while correction of the fuel delivery flow of the low-pressure pump is activated. The current second correction value is further determined as a function of the difference between a previous second correction value and a reset value when correction of the fuel delivery flow of the low-pressure pump is not activated, until the current second correction value has a neutral value. The fuel delivery flow of the low-pressure pump is corrected as a function of the second correction value. This has the advantage that any control or adjustment means that may be provided as necessary for the fuel pressure in the low-pressure circuit is relieved of overloading by the avoidance of large, erratic changes in the fuel delivery flow from the low-pressure pump when correction of the fuel delivery flow from the low-pressure pump has been deactivated.

In a further advantageous embodiment of the invention, a third correction value is determined when correction of the fuel delivery flow of the low-pressure pump is activated. The third correction value is determined as a function of the current and the preceding predetermined setpoint value of the fuel pressure in the fuel accumulator. The fuel delivery flow of the low-pressure pump is corrected as a function of the third correction value. Correction of the fuel delivery flow of the low-pressure pump is therefore particularly simple. A correction of the said kind can be made even if there is no control element available for changing the fuel delivery flow of the high-pressure pump at constant engine speed.

In this connection it is advantageous if the third correction value is determined from an engine operating map. This has the advantage that determining the third correction value is very easy and the required computational overhead is small.

BRIEF DESCRIPTION OF THE DRAWINGS

Exemplary embodiments of the invention are explained below with reference to the schematic drawings, in which.

Elements which have the same design or function are given the same reference characters in all the figures.

DETAILED DESCRIPTION OF INVENTION

Figure 1:
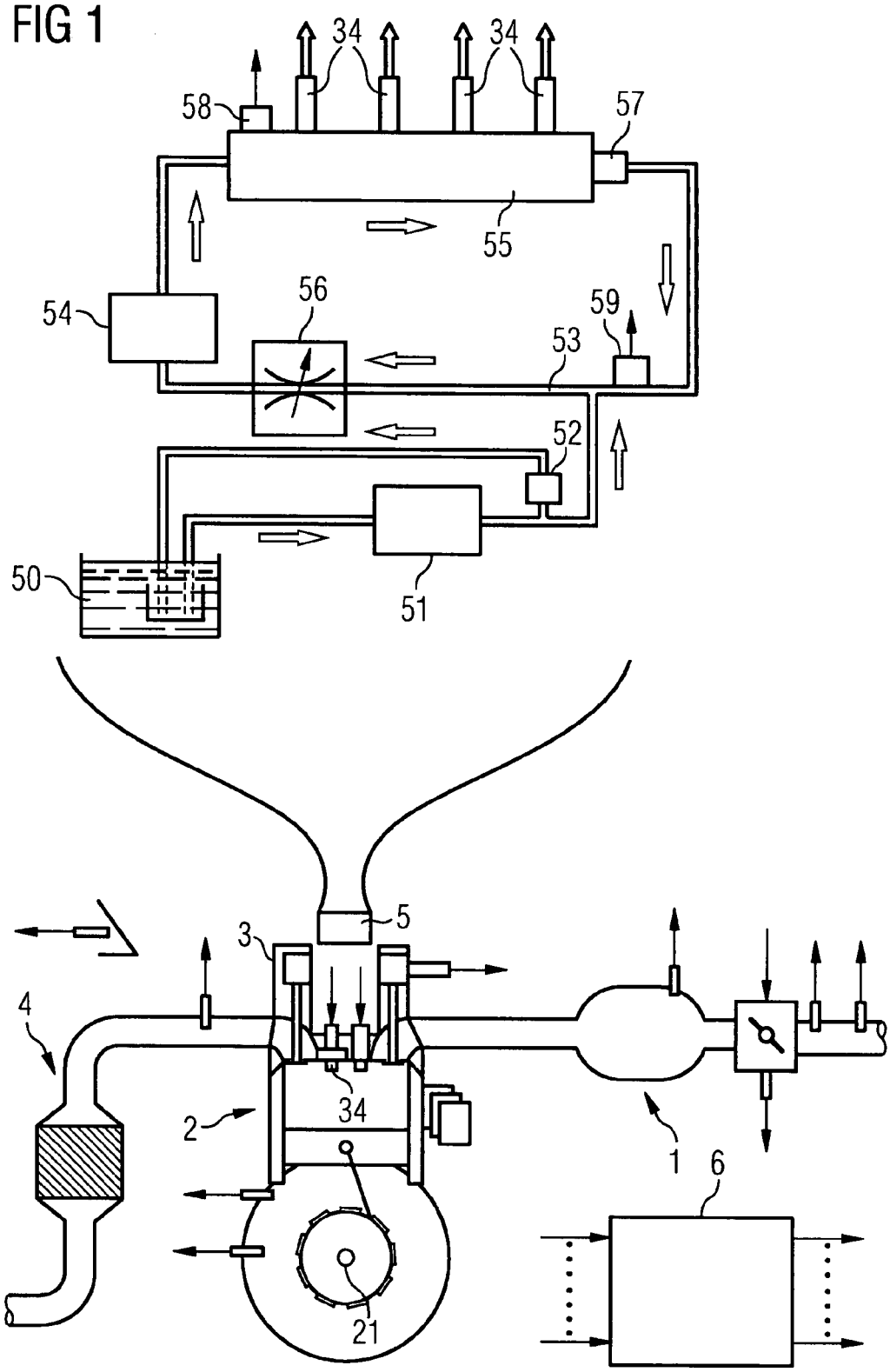
FIG. 1 shows an internal combustion engine with a fuel delivery device.

An internal combustion engine (FIG. 1) includes an intake duct 1, an engine block 2, a cylinder head 3 and an exhaust duct 4. The engine block 2 includes a plurality of cylinders having pistons and connecting rods via which they are coupled to a crankshaft 21.

The cylinder head 3 includes a valve train assembly having a gas inlet valve, a gas outlet valve and valve operating mechanisms. The cylinder head 3 further includes an injection valve 34 and a spark plug.

A fuel delivery device 5 is also provided. Said device has a fuel tank 50 which is connected via a first fuel line to a low-pressure pump 51. The low-pressure pump 51 is effectively linked on the output side to an inlet 53 of a high-pressure pump 54. Further the low-pressure pump 51 is provided on the output side with a pressure relief valve 52 which is connected on the output side to the fuel tank 50 via a further fuel line. The low-pressure pump 51, the pressure relief valve 52, the first fuel line, the further fuel line and the inlet 53 form a low-pressure circuit.

The low-pressure pump 51 is preferably designed so that when the internal combustion engine is operating, said pump always delivers a sufficient quantity of fuel to guarantee that the pressure does not fall below a predetermined minimum.

The inlet 53 feeds into the high-pressure pump 54 which on the output side conveys the fuel into a fuel accumulator 55. As a rule the high-pressure pump 54 is driven by the camshaft. Thus when the crankshaft 21 is running at a constant speed, said pump delivers a constant volume of fuel to the fuel accumulator 55.

The injection valves 34 are effectively connected to the fuel accumulator 55. The fuel is thus supplied to the injection valves 34 via the fuel accumulator 55.

Installed upstream of the high-pressure pump 54 is a volume flow control valve 56 which enables the volume flow supplied to the high-pressure pump 54 to be set. A setpoint value FUP_SP of the fuel pressure in the fuel accumulator 55 can be set by appropriately controlling the volume flow control valve 56. The volume flow control valve 56 is a servo drive that controls a fuel delivery flow of the high-pressure pump 54. The volume flow control valve 56 controls the fuel delivery flow of the high-pressure pump 54 as a function of a corrective signal PWM_HP of the high-pressure pump 54. Said signal may be a pulse-width modulated electrical current and the fuel delivery flow of the high-pressure pump 54 is then a function of its pulse width. The corrective signal PWM_HP of the high-pressure pump 54 is thus a quantity representative of the fuel delivery flow of the high-pressure pump 54.

As an alternative to the volume flow control valve 56 and the high-pressure pump 54, it is instead possible, for example, for the fuel delivery flow of the high-pressure pump 54 to be dependent on a triggering angle. The triggering angle corresponds to a crankshaft angle at which the high-pressure pump 54 starts to convey fuel into the fuel accumulator 55 on every revolution of the crankshaft. Delivery of the fuel ends in each case when the crankshaft reaches a predetermined crankshaft angle. In this case the triggering angle is a quantity representative of the fuel delivery flow from the high-pressure pump 54 and the corrective signal PWM_HP of the high-pressure pump 54 is for example the triggering angle.

The quantity that is representative of the fuel delivery flow from the high-pressure pump 54 may also be an estimated quantity determined as a function of determined, captured or predetermined operating variables of the internal combustion engine. In the same way a sensor can be provided in which the measurement variable is the fuel delivery flow of the high-pressure pump 54. The measured value of this measurement variable is then representative of the fuel delivery flow from the high-pressure pump 54.

The fuel delivery device 5 can alternatively or additionally be provided with an electromechanical pressure regulator 57 which is arranged on the output side of the fuel accumulator 55 and provided with a return line into the low-pressure circuit. A setpoint value FUP_SP of the fuel pressure in the fuel accumulator 55 can be set by appropriately controlling the electromechanical pressure regulator 57. If the fuel pressure in the fuel accumulator 55 is greater than the fuel pressure predetermined by appropriately controlling the electromechanical pressure regulator 57, the electromechanical pressure regulator 57 opens and fuel is drained off from the fuel accumulator 55 into the low-pressure circuit.

The volume flow control valve 56 can also be integrated into the high-pressure pump 54. A common servo drive can be assigned to the electromechanical pressure regulator 57 and the volume flow control valve 56.

A fuel delivery flow of the low-pressure pump 51 is dependent on a corrective signal PWM_LP of the low-pressure pump 51, which in the same way as the corrective signal PWM_HP of the high-pressure pump 54 may be a pulse-width modulated current and the fuel delivery flow of the low-pressure pump 51 is then a function of its pulse width.

The internal combustion engine is also provided with a control device 6, and this in turn is provided with sensors which capture different measurement variables and determine the measured value of each measurement variable. Dependent on at least one of the measurement variables, the control device 6 determines control variables that are then converted into corresponding corrective signals for regulating control elements with the aid of corresponding servo drives.

Said sensors can be for example a pedal position indicator which captures the position of a foot pedal, a crankshaft angle sensor which captures the crankshaft angle and to which a speed of rotation is then assigned, a mass airflow sensor, a first fuel pressure sensor 58 which captures an actual value FUP_AV for the fuel pressure in the fuel accumulator 55, and a second fuel pressure sensor 59 which captures an actual value for the fuel pressure in the low-pressure circuit. There may be a smaller or greater number of sensors, depending on the embodiment of the invention.

Control elements may for instance be in the form of gas inlet valves or gas outlet valves, injection valves 34, spark plugs, throttle valves, low-pressure pump 51, volume flow control valve 56 or electromechanical pressure regulator 57.

The internal combustion engine preferably also has further cylinders to which corresponding control elements are then assigned.

Figure 2:
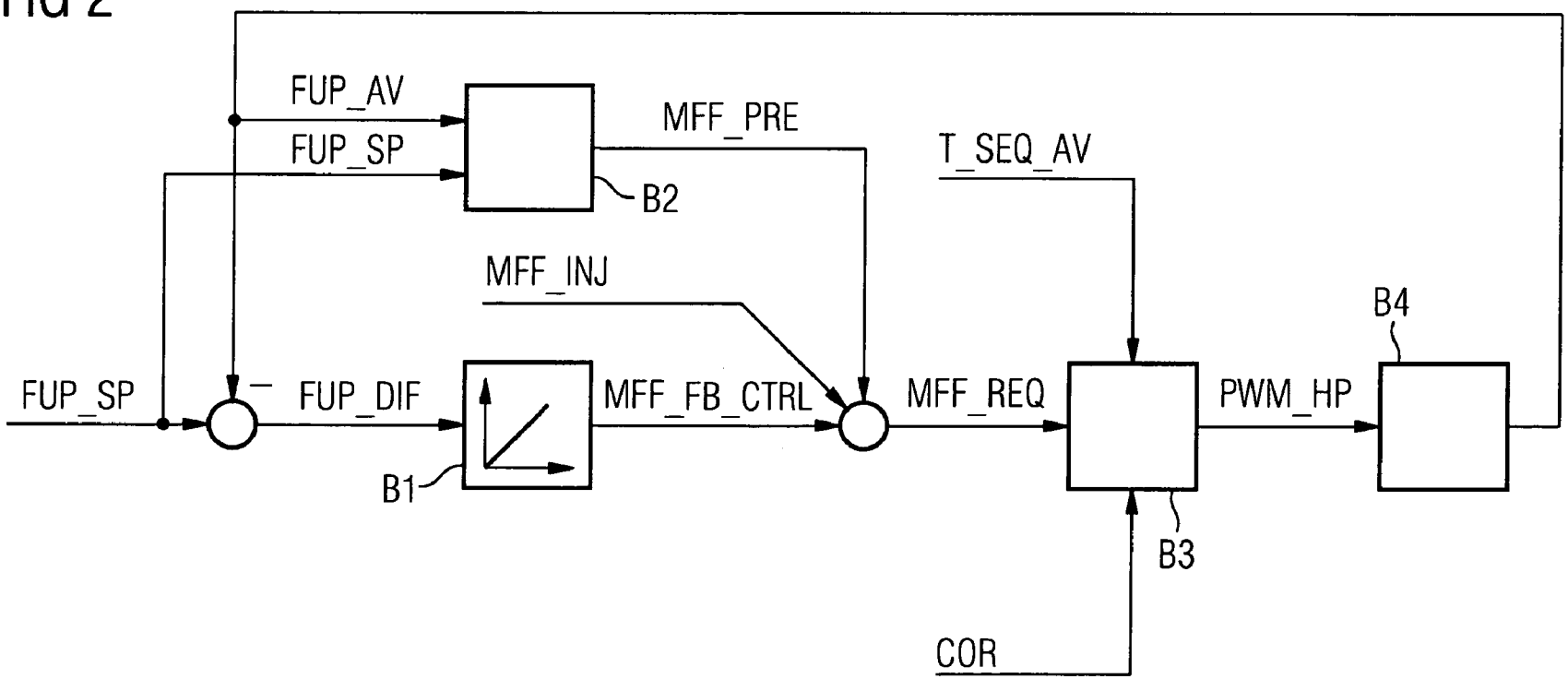
FIG. 2 is the block diagram of a control device for adjusting the fuel pressure in a fuel accumulator.

FIG. 2 shows a block diagram of a control device which can be used to adjust the fuel pressure in the fuel accumulator 55 during a first operating mode of the fuel delivery device 5. The fuel pressure in the fuel accumulator 55 is dependent on the set quantity of fuel conveyed by the high-pressure pump 54 from the low-pressure circuit into the fuel accumulator 55. The quantity of fuel can be a fuel mass or a fuel volume. The quantity of fuel conveyed is dependent on the fuel delivery flow of the high-pressure pump 54, said flow being set by the corrective signal PWM_HP of the high-pressure pump 54.

If more fuel is conveyed into the fuel accumulator 55 than is injected into the combustion chambers of the internal combustion engine, the fuel pressure rises in the fuel accumulator 55. If less fuel is conveyed into the fuel accumulator 55 than is injected into the combustion chambers of the internal combustion engine, the fuel pressure falls correspondingly in the fuel accumulator 55.

In a second operating mode of the fuel delivery device 5 the volume flow control valve 56 is preferably closed. Only a very small flow seeps through the volume flow control valve 56 if the need arises. The second operating mode can also be used if no volume flow control valve 56 is available in the fuel delivery device and the high-pressure pump 54 conveys virtually the same quantity of fuel from the low-pressure circuit into the fuel accumulator 55 with each revolution of the crankshaft 21. If the electromechanical pressure regulator 57 is closed and less fuel is injected into the combustion chambers of the internal combustion engine than is conveyed into the fuel accumulator 55, fuel pressure rises in the fuel accumulator 55 until the electromechanical pressure regulator 57 opens and redirects fuel into the inlet 53. This limits the fuel pressure in the fuel accumulator 55 to the setpoint value FUP_SP for fuel pressure.

A difference between the setpoint value FUP_SP of the fuel pressure and the actual value FUP_AV of the fuel pressure is used to determine a control difference FUP_DIF. The control difference FUP_DIF is supplied to a controller in block B1. This controller is preferably designed as a PI controller. In block B1 a control value MFF_FB_CTRL is defined. The setpoint value FUP_SP of the fuel pressure and the actual value FUP_AV of the fuel pressure are used in a block B2 to determine a precontrol value MFF_PRE. The precontrol value MFF_PRE, the control value MFF_FB_CTRL and a fuel mass MFF_INJ to be injected are summed together into a fuel mass MFF_REQ to be conveyed, preferably the fuel mass to be conveyed per cylinder segment.

The fuel mass MFF_REQ to be conveyed, a segment interval T_SEG_AV and correction variables COR are used in a block B3 to determine the corrective signal PWM_HP of the high-pressure pump 54. Preferably the fuel mass MFF_REQ to be conveyed is divided by the segment interval T_SEG_AV and multiplied by a correction factor determined from the correction variables COR, in particular the fuel density in the fuel accumulator 55. The segment interval T_SEG_AV is equal to the duration needed for one revolution of the crankshaft 21 divided by half the number of cylinders in the internal combustion engine, since injection into the same cylinder occurs only every second revolution of the crankshaft 21. The correction variables COR include for example the fuel density in the fuel accumulator 55 and/or a fuel temperature.

A block B4 represents the fuel delivery device 5 shown in FIG. 1. The corrective signal PWM_HP of the high-pressure pump 54 is the input variable for the block B4. The output variable of the block B4 is the actual value FUP_AV of the fuel pressure, captured for example by means of the fuel pressure sensor 58.

A corresponding control device can also be provided for the second operating mode of the fuel delivery device 5, in which a corrective signal for the electromechanical pressure regulator 57 is generated for the purpose of controlling the fuel pressure in the fuel accumulator 55.

If the fuel pressure in the fuel accumulator 55 is reduced, some of the fuel mass additionally stored in the volume of the fuel accumulator 55 at the previously higher fuel pressure compared to the lower fuel pressure prevailing following the pressure reduction is freed up due to the compressibility of the fuel. Said fuel mass is dependent on the pressure difference between the fuel pressure in the fuel accumulator 55 before and after the pressure reduction, on the volume that is filled with fuel in the fuel accumulator 55, on the fuel density and on the compressibility of the fuel.

The fuel pressure in the fuel accumulator 55 can be reduced to a predetermined fuel pressure by reducing the fuel delivery flow of the high-pressure pump 54, compared to the fuel delivery flow immediately before the start of the pressure reduction, until enough fuel is directed away from the fuel accumulator 55 into the combustion chambers of the internal combustion engine by fuel injection processes. In this case less fuel may be taken from the low-pressure circuit than is conveyed by the low-pressure pump 51 into the inlet 53. In the same way fuel in the low-pressure circuit can be directed away from the fuel accumulator 55 into the inlet 53 via the electromechanical pressure regulator 57. In this case fuel is introduced into the low-pressure circuit in addition to the fuel conveyed by the low-pressure pump 51. In both cases, therefore, fuel pressure in the low-pressure circuit can increase to more than the predetermined fuel pressure. This places an additional load on the components of the low-pressure circuit and can reduce their reliability and service life.

Figure 3:
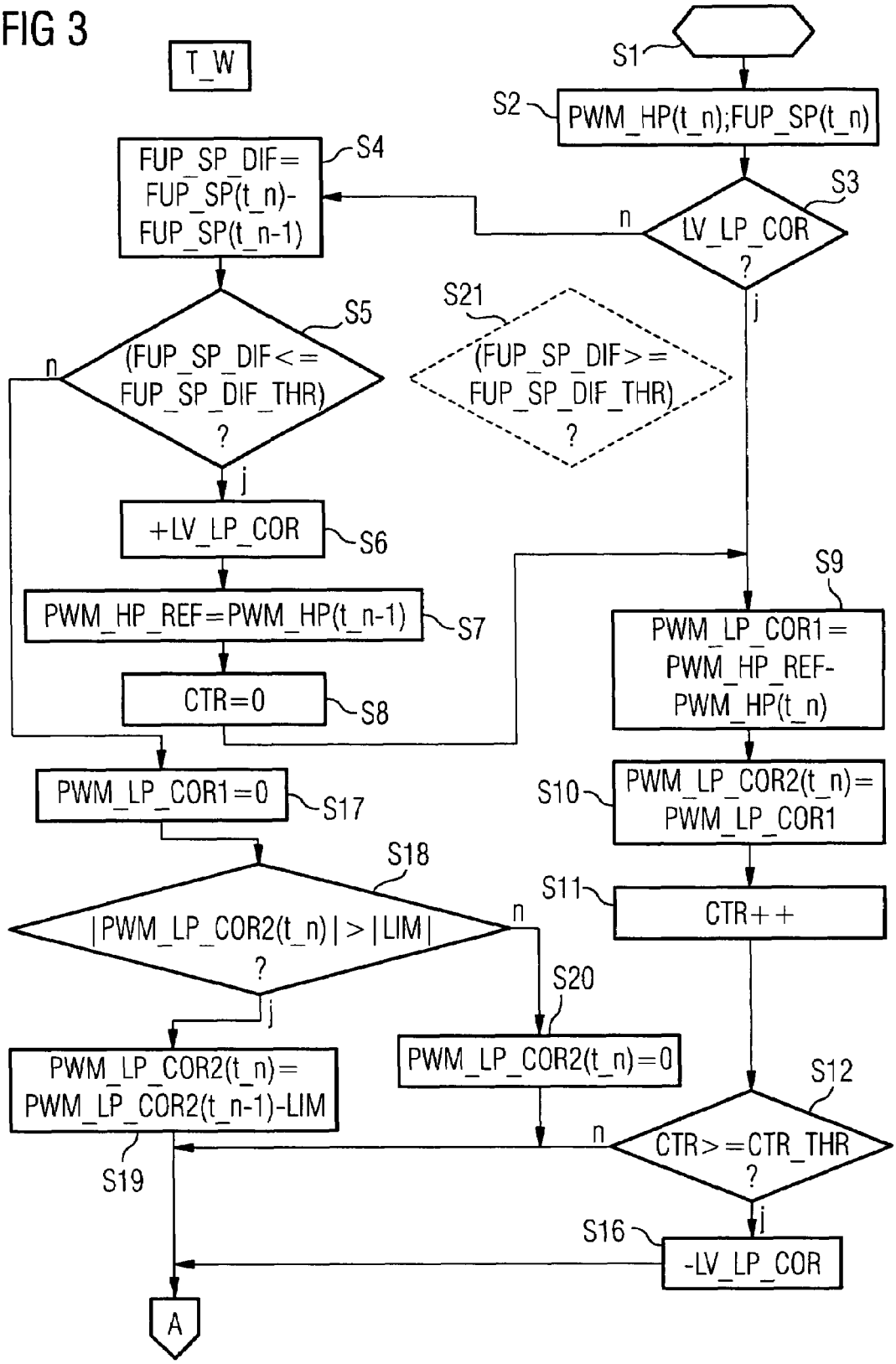
FIGS. 3, 4 show a flowchart for a first embodiment of a program for determining the fuel delivery flow of the low-pressure pump.
Figure 4:
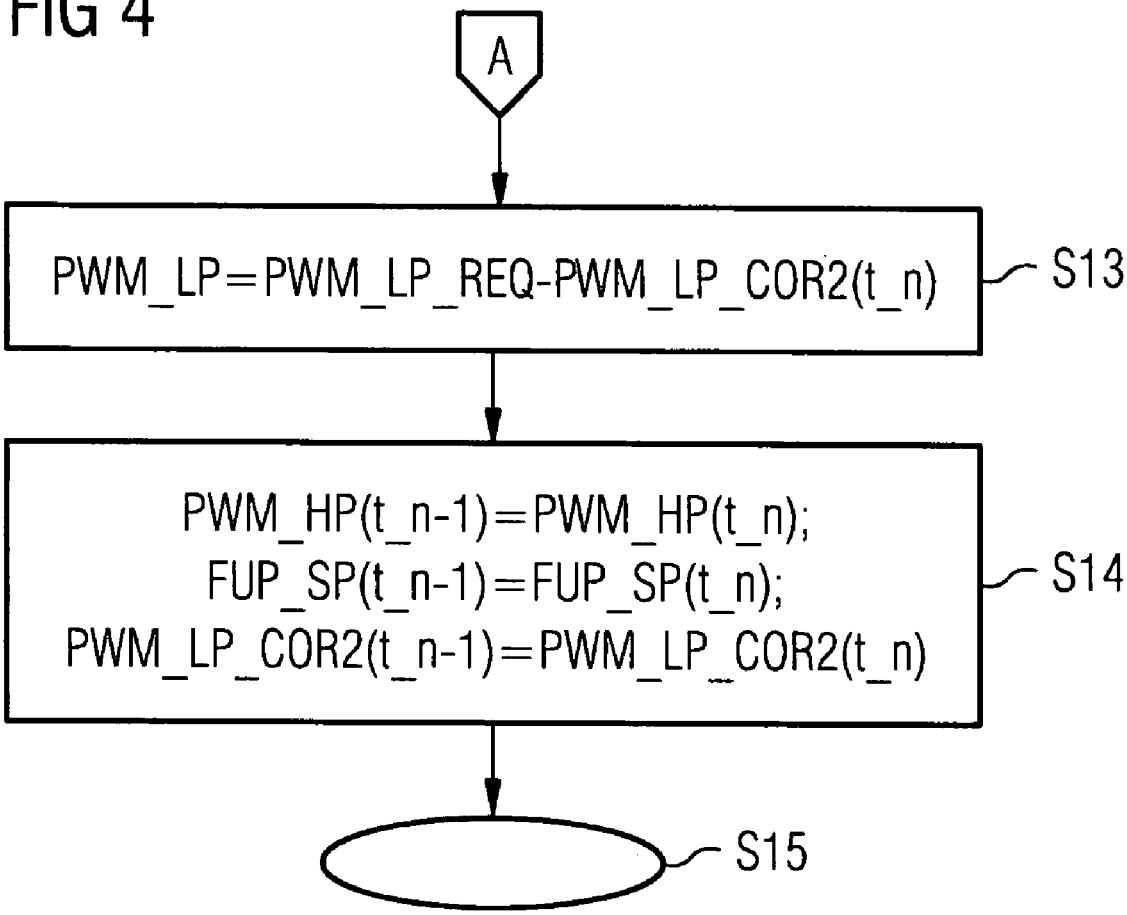

FIGS. 3 and 4 show a flowchart for a first embodiment of a program for determining the fuel delivery flow of the low-pressure pump 51. The program is stored in the control device 6 and is run while the internal combustion engine is operating. The program starts at a step S1 (FIG. 3) in which necessary preparations are made, particularly when the program is executed for the first time. For example logical variables are assigned their predetermined values or counters are reset.

In a step S2 the corrective signal PWM_HP of the high-pressure pump 54 and the setpoint value FUP_SP of the fuel pressure are determined at a current instant t_n. The corrective signal PWM_HP of the high-pressure pump 54 may for example be determined as shown in FIG. 2. In a step S3 a check is made on whether a logical variable LV_LP_COR has been assigned a predetermined logical value, e.g. one. The logical variable LV_LP_COR represents the activation status of the fuel delivery flow correction for the low-pressure pump 51.

If the condition in the step S3 is not fulfilled, that is, if correction to the fuel delivery flow of the low-pressure pump 51 is not activated, then in a step S4 a setpoint value difference in fuel pressure FUP_SP_DIF between the setpoint value FUP_SP of the fuel pressure at the current instant t_n and the setpoint value FUP_SP of the fuel pressure at a previous instant t_n−1 is determined. In the event that the setpoint value FUP_SP of the fuel pressure is reduced, the setpoint value difference FUP_SP_DIF of the fuel pressure is negative.

In a step S5 the setpoint value difference FUP_SP_DIF determined for the fuel pressure is checked. If the setpoint value difference FUP_SP_DIF of the fuel pressure is less than or equal to a threshold value FUP_SP_DIF_THR of the setpoint value difference FUP_SP_DIF for the fuel pressure, then in a step S6 correction of the fuel delivery flow is activated for the low-pressure pump by assigning the associated logical value, e.g. one, to the logical variable LV_LP_COR. The threshold value FUP_SP_DIF_THR of the setpoint value difference FUP_SP_DIF for the fuel pressure is preferably negative.

In a step S7 the corrective signal PWM_HP of the high-pressure pump 54 at the previous instant t_n−1 is saved as a reference value PWM_HP_REF for the corrective signal PWM_HP of the high-pressure pump 54. In a step S8 a counter CTR is reset, for example to zero.

In a step S9, a first correction value PWM_LP_COR1 is determined from the reference value PWM_HP_REF for the corrective signal PWM_HP of the high-pressure pump 54 and the corrective signal PWM_HP of the high-pressure pump 54 at the current instant t_n. In a step S10 the value of the first correction value PWM_LP_COR1 is assigned to a second correction value PWM_LP_COR2 at the current instant t_n. In a step S11 the counter CTR is incremented by for example one. In a step S12 the counter CTR is checked. If the counter CTR is less than a predetermined threshold value CTR_THR for the counter CTR, the program is continued in a step S13.

In a step S13 the corrective signal PWM_LP of the low-pressure pump 51 is determined as the difference between a corrective signal request PWM_LP_REQ for the low-pressure pump 51 and the second correction value PWM_LP_COR2 at the current instant t_n. The corrective signal request PWM_LP_REQ for the low-pressure pump 51 is determined for example as a function of a setpoint value for the fuel pressure in the low-pressure circuit, a fuel temperature, and a setpoint value for the fuel delivery flow of the low-pressure pump 51, as disclosed in DE 101 62 989 C1, which is incorporated herein by reference.

In a step S14 the corrective signal PWM_HP of the high-pressure pump 54 at the current instant t_n is saved as a corrective signal PWM_HP for the high-pressure pump 54 at the previous instant t_n−1. The setpoint value FUP_SP of the fuel pressure at the current instant t_n is correspondingly stored as the setpoint value FUP_SP of the fuel pressure at the previous instant t_n−1, and the second correction value PWM_LP_COR2 at the current instant t_n is stored as the second correction value PWM_LP_COR2 at the previous instant t_n−1.

In a step S15 the program run is concluded and then continued in the step S1 after a waiting time T_W (FIG. 3). The waiting time T_W can for example be equal to the segment interval T_SEG_AV and specifies the time interval in which the program is executed. The time interval between the current instant t_n and the previous instant t_n−1 is preferably equal to the waiting time T_W. The previous instant t_n−1 can however also be assigned to an instant at which an operating variable of the internal combustion engine was last stationary. Thus the setpoint value FUP_SP of the fuel pressure at the previous instant t_n−1 is preferably equal to the last stationary setpoint value FUP_SP of the fuel pressure in the fuel accumulator 55 and the setpoint value FUP_SP of the fuel pressure at the current instant t_n is the new stationary target value to which the fuel pressure in the fuel accumulator 55 needs to be set or adjusted.

If the condition in the step S3 is fulfilled, that is, if correction to the fuel delivery flow of the low-pressure pump 51 is activated, the program is continued in the step S9.

If in the step S12 the counter CTR is equal to or greater than the predetermined threshold value CTR_THR of the counter CTR, the activation status of the fuel delivery flow correction for the low-pressure pump 51 is reset in a step S16 by assigning the associated logical value, e.g. zero, to the logical variable LV_LP_COR. The program is then continued in the step S13.

If the condition in the step S5 is not fulfilled, that is, if the setpoint value difference FUP_SP_DIF of the fuel pressure is greater than the threshold value FUP_SP_DIF_THR for the setpoint value difference FUP_SP_DIF of the fuel pressure, the program is continued in the step S17. In the step S17 the first correction value PWM_LP_COR1 is assigned a neutral value, e.g. zero.

In a step S18 a check is made on whether the amount of the second correction value PWM_LP_COR2 at the current instant t_n is greater than the amount of a reset value LIM. If this condition is fulfilled, then in a step S19 a difference between the second correction value PWM_LP_COR2 at the previous instant t_n−1 and the reset value LIM is assigned to the second correction value PWM_LP_COR2 at the current instant t_n. The program is then continued in the step S13. If however the condition in the step S18 is not fulfilled, then in a step S20 the second correction value PWM_LP_COR2 at the current instant t_n is assigned a neutral value, e.g. zero. The program is then continued in the step S13.

Correction to the fuel delivery flow of the low-pressure pump 51 can likewise be activated if the setpoint value FUP_SP of the fuel pressure rises. In this case the setpoint value difference FUP_SP_DIF determined for the fuel pressure in the step S4 is positive. The step S5 is then replaced by a step S21, in which a check is made on whether the setpoint value difference FUP_SP_DIF of the fuel pressure is equal to or greater than the threshold value FUP_SP_DIF_THR for the setpoint value difference FUP_SP_DIF of the fuel pressure. The threshold value FUP_SP_DIF_THR is preferably positive. If the condition in the step S21 is fulfilled, the program is continued in the step S6. Otherwise the program is continued in the step S17.

The threshold value CTR_THR of the counter CTR is preferably chosen so that correction to the fuel delivery flow of the low-pressure pump 51 is only activated for a duration in the order of magnitude of some few hundred milliseconds, e.g. for three hundred milliseconds, that is, the logical variable LV_LP_COR is reset in the step S16 just a few hundred milliseconds after it was set in the step S6. During this duration the counter CTR counts the number of program runs until the condition in the step S12 is fulfilled.

In the steps S18 and S19 the reset value LIM is chosen so that the amount of the second correction value PWM_LP_COR2 at the current instant t_n decreases toward a neutral value, e.g. zero, at each time step, for example after every expiration of the waiting time T_W. The neutral value is preferably reached after a few hundred milliseconds, for example after three hundred milliseconds.

Figure 5:
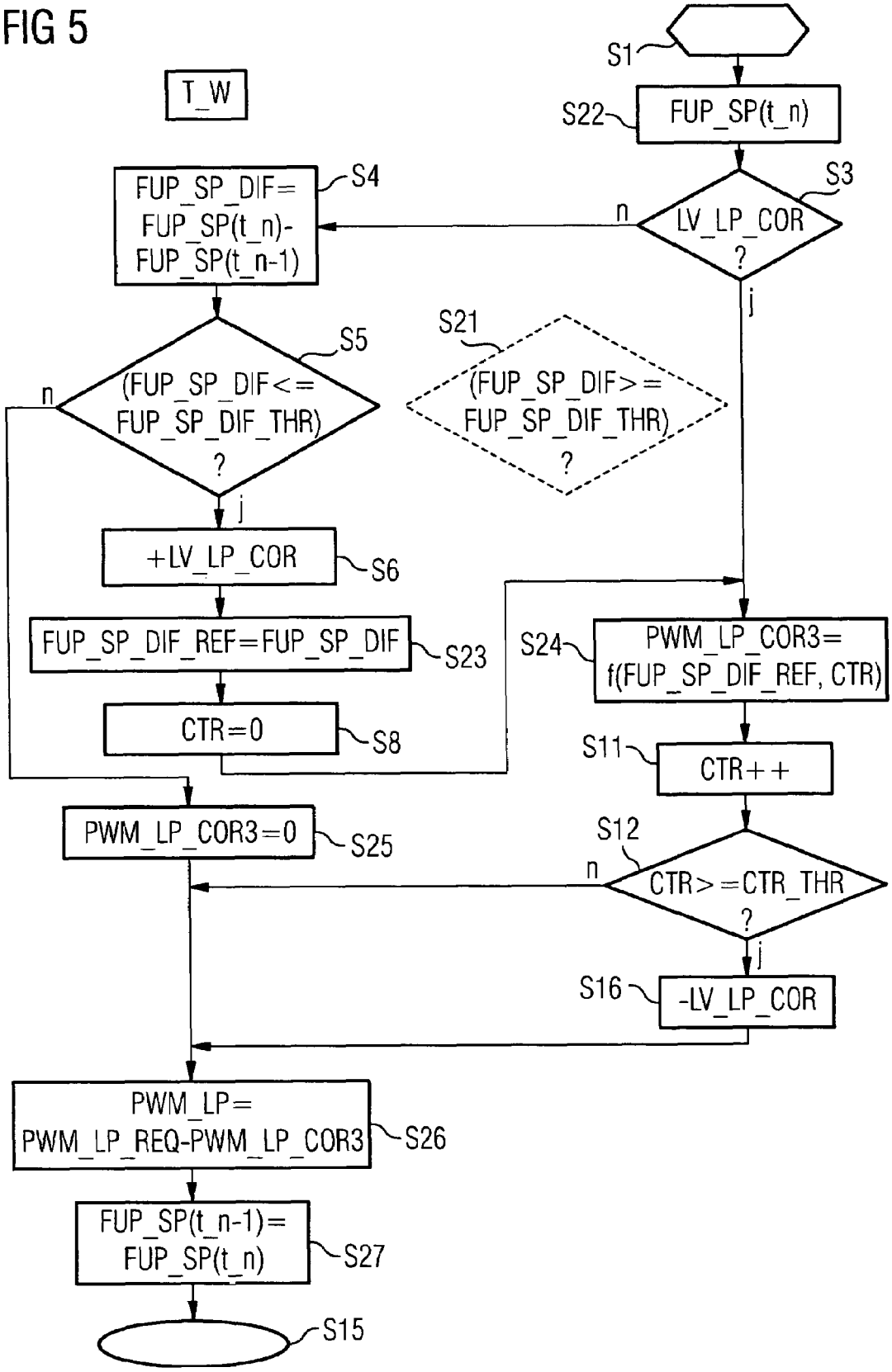
FIG. 5 shows a flowchart for a second embodiment of the program for determining the fuel delivery flow of the low-pressure pump.

FIG. 5 shows a flowchart for a second embodiment of the program for determining the fuel delivery flow of the low-pressure pump 51. The steps S1, S3 to S6, S8, S11, S12, S15, S16 and S21 are executed in accordance with the first embodiment of the program. The step S2 is replaced by a step S22, in which the setpoint value FUP_SP of the fuel pressure at the current instant t_n is determined. The program is continued in the step S3. The step S7 is replaced by a step S21, in which the setpoint value difference FUP_SP_DIF of the fuel pressure is stored as a reference value FUP_SP_DIF_REF for the setpoint value difference FUP_SP_DIF of the fuel pressure. The program is then continued in the step S8.

After the step S8, or if the condition in the step S3 is fulfilled, that is, correction to the fuel delivery flow of the low-pressure pump 51 is activated, then in a step S24, which replaces the step S9, a third correction value PWM_LP_COR3 is determined as a function of the stored reference value FUP_SP_DIF_REF for the setpoint value difference FUP_SP_DIF of the fuel pressure and as a function of the counter CTR. This may be carried out for example by means of an engine operating map in which are stored suitable values that have preferably been determined in advance by trials on an engine test bench, by simulation or by road trials. Alternatively functions such as those based on physical models can also be used. Following the step S24, the program is continued in the step S11.

If the condition in the step S5 is not fulfilled, that is, if the setpoint value difference FUP_SP_DIF of the fuel pressure is greater than the threshold value FUP_SP_DIF_THR for the setpoint value difference FUP_SP_DIF of the fuel pressure, then in a step S25, which replaces the steps S17 to S20, the third correction value PWM_LP_COR3 is assigned a neutral value, e.g. zero. The program is then continued in a step S26.

Similarly, following the step S16 the program is continued in the step S26. In the step S26 the corrective signal PWM_LP of the low-pressure pump 51 is determined as the difference between the corrective signal request PWM_LP_REQ for the low-pressure pump 51 and the third correction value PWM_LP_COR3. In a step S27 the setpoint value FUP_SP of the fuel pressure at the current instant t_n is then stored as the setpoint value FUP_SP of the fuel pressure at the previous instant t_n−1; the program run is then concluded in the step S15 and continued in the step S1 after the waiting time T_W.

The invention claimed is:

1. A method for controlling an internal combustion engine having a fuel delivery device, comprising:

providing a low-pressure circuit with a low-pressure pump; and coupling a high-pressure pump on an input side to the low-pressure circuit where the high-pressure pump delivers fuel to a fuel accumulator, wherein a fuel delivery flow of the low-pressure pump is corrected as a function of a current and a preceding predetermined setpoint value of the fuel pressure in the fuel accumulator.

2. The method as claimed in claim 1, wherein correction of the fuel delivery flow of the low-pressure pump is activated as a function of the current and the preceding predetermined setpoint values of the fuel pressure in the fuel accumulator.

3. The method as claimed in claim 2, wherein a first correction value is determined, when correction to the fuel delivery flow of the low-pressure pump is activated, as a function of a current and a preceding quantity, the quantity being representative of a fuel delivery flow Of the high-pressure pump, which fuel delivery flow is set in each case as a function of the current predetermined setpoint value of the fuel pressure in the fuel accumulator, and wherein the fuel delivery flow of the low-pressure pump is corrected as a function of the first correction value.

4. The method as claimed in claim 3, wherein the first correction value is assigned a neutral value after a predetermined interval immediately following the activation of correction to the fuel delivery flow of the low-pressure pump.

5. The method as claimed in claim 4, wherein a current second correction value is determined which is equal to the first correction value, while correction of the fuel delivery flow of the low-pressure pump is activated, and which is dependent on a difference between the preceding second correction value and a reset value, when correction of the fuel delivery flow of the low-pressure pump is not activated, until the current second correction value has a neutral value, and wherein the fuel delivery flow of the low-pressure pump is corrected as a function of the second correction value.

6. The method as claimed in claim 2, wherein a third correction value is determined, when correction to the fuel delivery flow of the low-pressure pump is activated, as a function of the current and the preceding predetermined setpoint value of the fuel pressure in the fuel accumulator, and wherein the fuel delivery flow of the low-pressure pump is corrected as a function of the third correction value.

7. The method as claimed in claim 6, wherein the third correction value is determined from an engine operating map.

8. A device for controlling an internal combustion engine with the aid of a fuel delivery device, comprising:

a low-pressure circuit having a low-pressure pump, and a high-pressure pump coupled on the input side to the low-pressure circuit and to a fuel accumulator on an output side where an output flow is delivered to the accumulator; and a fuel delivery flow correction device that corrects a fuel delivery flow of the low-pressure pump as a function of a current and a preceding predetermined setpoint value for the fuel pressure in the fuel accumulator.

9. The device as claimed in claim 8, wherein correction of the fuel delivery flow of the low-pressure pump is activated as a function of the current and the preceding predetermined setpoint values of the fuel pressure in the fuel accumulator.

10. The device as claimed in claim 9, wherein a first correction value is determined, when correction to the fuel delivery flow of the low-pressure pump is activated, as a function of a current and a preceding quantity, the quantity being representative of a fuel delivery flow of the high-pressure pump, which fuel delivery flow is set in each case as a function of the current predetermined setpoint value of the fuel pressure in the fuel accumulator, and wherein the fuel delivery flow of the low-pressure pump is corrected as a function of the first correction value.

11. The device as claimed in claim 10, wherein the first correction value is assigned a neutral value after a predetermined interval immediately following the activation of correction to the fuel delivery flow of the low-pressure pump.

12. The method as claimed in claim 11, wherein a current second correction value is determined which is equal to the first correction value, while correction of the fuel delivery flow of the low-pressure pump is activated, and which is dependent on a difference between the preceding second correction value and a reset value, when correction of the fuel delivery flow of the low-pressure pump is not activated, until the current second correction value has a neutral value, and wherein the fuel delivery flow of the low-pressure pump is corrected as a function of the second correction value.

13. The method as claimed in claim 9, wherein a third correction value is determined, when correction to the fuel delivery flow of the low-pressure pump is activated, as a function of the current and the preceding predetermined setpoint value of the fuel pressure in the fuel accumulator, and wherein the fuel delivery flow of the low-pressure pump is corrected as a function of the third correction value.

14. The method as claimed in claim 13, wherein the third correction value is determined from an engine operating map.

* * * * *